US009085892B1

(12) United States Patent
Wilson

(10) Patent No.: US 9,085,892 B1
(45) Date of Patent: Jul. 21, 2015

(54) DRAIN SYSTEM

(71) Applicant: James G. Wilson, Lancaster, PA (US)

(72) Inventor: James G. Wilson, Lancaster, PA (US)

( * ) Notice: Subject to any disclaimer, the term of this patent is extended or adjusted under 35 U.S.C. 154(b) by 0 days.

(21) Appl. No.: 13/914,653

(22) Filed: Jun. 11, 2013

Related U.S. Application Data

(60) Provisional application No. 61/661,439, filed on Jun. 19, 2012.

(51) Int. Cl.

| | |
|---|---|
| ***E06B 7/14*** | (2006.01) |
| ***E04B 1/70*** | (2006.01) |
| ***E02D 31/06*** | (2006.01) |
| ***E04F 17/00*** | (2006.01) |

(52) U.S. Cl.
CPC . *E04B 1/70* (2013.01); *E02D 31/06* (2013.01); *E04F 17/00* (2013.01)

(58) Field of Classification Search
CPC ..... E04B 1/70; E04B 5/43; E04B 1/0046; E04B 2013/0463; E02D 31/06; E02D 31/02; E04F 17/00
USPC ..... 52/169.5, 302.1, 302.3, 302.7, 97, 209, 52/473; 49/408; 454/270, 271
See application file for complete search history.

(56) References Cited

U.S. PATENT DOCUMENTS

| | | | | |
|---|---|---|---|---|
| 4,026,082 | A * | 5/1977 | Crofoot | 52/302.7 |
| 5,822,934 | A | 10/1998 | O'Donnell | |
| 6,973,757 | B2 | 12/2005 | Marks | |
| 7,937,899 | B2 | 5/2011 | Earls | |
| 2004/0163342 | A1 * | 8/2004 | Marks | 52/302.1 |
| 2009/0151274 | A1 * | 6/2009 | Earls | 52/169.5 |
| 2009/0223147 | A1 * | 9/2009 | Spignesi | 52/169.5 |

* cited by examiner

*Primary Examiner* — Brian Glessner
*Assistant Examiner* — Brian D Mattei
(74) *Attorney, Agent, or Firm* — Pearne & Gordon LLP

(57) ABSTRACT

A liquid draining structure can pass a liquid from a first side of a barrier to a second side of the barrier. The liquid draining structure can include a liquid conductor, including an entry end located at the barrier first side and a discharge end located at the barrier second side. The liquid conductor can define a passageway that extends through the liquid conductor. The liquid draining structure also can include a securing member releasably attachable to the liquid conductor at any one of a plurality of positions. The securing member can engage the barrier, preventing the movement of the liquid conductor. The securing member can be attached to the second side of the barrier. The liquid draining structure can include a flange secured at the entry end of the liquid conductor and engaging the first side of the barrier, preventing the movement of the liquid conductor.

24 Claims, 9 Drawing Sheets

FIG. 6
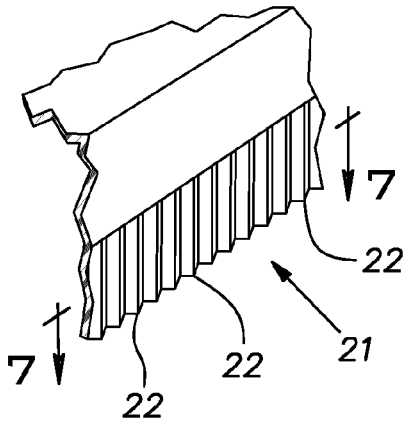
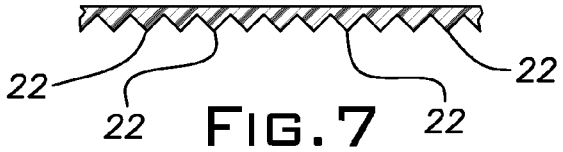
FIG. 7
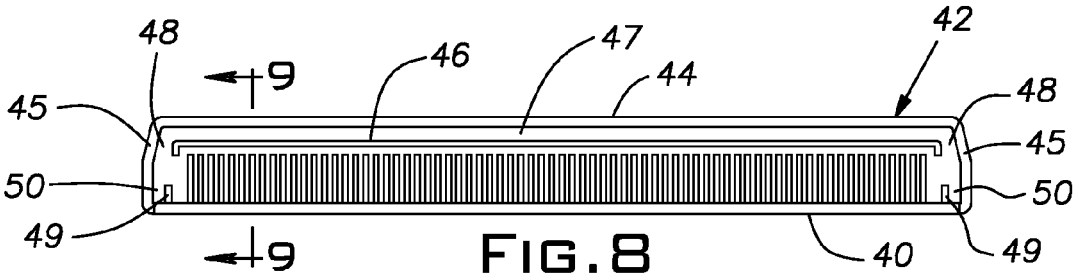
FIG. 8
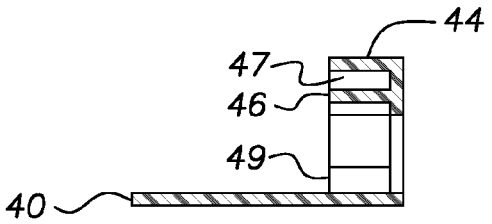
FIG. 9

DRAIN SYSTEM

CROSS-REFERENCE TO RELATED APPLICATION

This application claims the benefit of the filing date of Provisional Application Ser. No. 61/661,439 which was filed on Jun. 19, 2012 and which, by this reference thereto, is incorporated herein in its entirety for all purposes.

BACKGROUND OF THE INVENTION

1. Field of the Invention

This invention concerns in general a drain system for passing a liquid from a first location to a second location through a barrier. In particular, the invention relates to a liquid draining structure configured to pass a liquid from a floor of an interior of a screened enclosure to an exterior of the enclosure through a structure situated on the floor and supporting the enclosure.

2. Description of Related Art

A variety of instances exist concerning which it is required or desirable to convey or pass a liquid from a first location to a second location through a barrier. For example, in certain structures such as a screened enclosure, water can accumulate at the surface of an interior floor of the enclosure. The water accumulation can be the result, for example, of rain water entering the enclosure through the openings in the enclosure's screen or the result of water pooling at the surface of the interior floor following the washing of the surface of the interior floor or other structures at the interior of the enclosure. It can be undesirable to allow the accumulated water to remain at the surface of the interior floor until the water evaporates, given the fact that the accumulated water can have deleterious effects on the interior floor surface and can interfere with the use of the enclosure.

Certain drain systems have been proposed for installation with structures such as a screened enclosure for example, whereby water that has accumulated at the surface of the interior floor of the enclosure can be passed from the interior of the enclosure to the exterior of the enclosure through the base rails that are situated at the floor of the enclosure and to which the screen walls of the enclosure are attached. However, alternative drain systems for effectively and efficiently removing accumulated water from the interior floors of enclosures, such as screened enclosures around patios and swimming pools for example, remain of interest.

BRIEF SUMMARY OF THE INVENTION

The following sets forth a simplified summary of the present invention for the purpose of proving a basic understanding of selected aspects, embodiments and examples of the invention. The summary does not constitute an extensive overview of all aspects, embodiments or examples of the invention. Neither is the summary intended to identify critical features or delineate the scope of the invention. The sole purpose of the summary is to present selected aspects, embodiments and examples in a brief form as an introduction to the more detailed description of the aspects, embodiments and examples that follow the summary.

According to a first aspect, a liquid draining structure is configured to pass a liquid from a first side of a barrier through the barrier to a second side of the barrier. The liquid draining structure can include a liquid conductor that includes an entry end and a discharge end. The entry end can be configured to be located at the first side of the barrier, and the discharge end can be configured to be located at the second side of the barrier. The liquid conductor can define at least in part a passageway that extends through the liquid conductor from the entry end of the liquid conductor to the discharge end of the liquid conductor through which the liquid can pass from the entry end of the liquid conductor to the discharge end of the liquid conductor through the barrier. The liquid draining structure also can include a securing member releasably attachable to the liquid conductor at any one of a plurality of positions between the entry end and the discharge end of the liquid conductor at the second side of the barrier. The securing member can be configured to engage the barrier at the second side of the barrier, thereby preventing the movement of the liquid conductor in a direction from the second side of the barrier toward the first side of the barrier when the securing member engages the barrier at the second side of the barrier. Additionally, according to a further embodiment, the securing member can be configured to be attached to the barrier at the second side of the barrier, thereby maintaining the liquid conductor in place and preventing the movement of the liquid conductor both in a direction from the second side of the barrier toward the first side of the barrier and in a direction from the first side of the barrier to the second side of the barrier when the securing member is attached to the barrier at the second side of the barrier.

According to a first embodiment of the first aspect, the liquid conductor can include an open bottom and be configured to rest at least in part on a surface that extends from the first side of the barrier beneath the barrier to the second side of the barrier, whereby the surface comprises a bottom portion of the passageway. A portion of each of the liquid conductor, including the discharge end of the liquid conductor, and a portion of the passageway can be configured to extend beyond an outer boundary of the surface at the second side of the barrier. A closure element can be removably attachable to the discharge end of the liquid conductor and be configured to close off the bottom portion of the passageway that is configured to extend beyond the outer boundary of the surface at the second side of the barrier.

According to a second embodiment of the first aspect, the liquid draining structure can include a flange that is secured at the entry end of the liquid conductor and is configured to engage the barrier at the first side of the barrier, thereby preventing the movement of the liquid conductor in a direction from the first side of the barrier towards the second side of the barrier when the flange engages the barrier at the first side of the barrier.

According to a third embodiment of the first aspect, the liquid conductor can include a first opening located at the entry end of the liquid conductor in liquid communication with the passageway and an entry screening element can be located at the first opening. The entry screening element can be configured to allow the entry of liquid through the first opening from the first side of the barrier into the passageway at the entry end of the liquid conductor, while precluding the entry through the first opening into the passageway of material that would materially compromise the free flow of liquid through the passageway.

According to a first example of the third embodiment of the first aspect, the liquid conductor can include a second opening located at the discharge end of the liquid conductor in liquid communication with the passageway and a discharge screening element can be located at the second opening. The discharge screening element can be configured to allow the discharge of liquid through the second opening from the passageway, while both precluding the entry into the passageway at the discharge end of the liquid conductor of material that would materially compromise the free flow of liquid through the passageway and limiting an access for pests to enter the passageway at the second opening. In a first mode of this first example, the entry screening element can be releasably attachable at the entry end of the liquid conductor.

According to a fourth embodiment of the first aspect, the liquid conductor can include a liquid conductor body member, defining at least in part the passageway, and a liquid conductor end member. The liquid conductor body member can include a body member first end that can substantially coincide with the entry end of the liquid conductor and a body member second end that can substantially coincide with the discharge end of the liquid conductor. The liquid conductor end member can be releasably attachable to the body member second end.

According to a first example of the fourth embodiment of the first aspect, the liquid conductor body member can include a first opening located at the entry end of the liquid conductor in liquid communication with the passageway. An entry screening element can be located at the first opening and be configured to allow the entry of liquid through the first opening from the first side of the barrier into the passageway at the entry end of the liquid conductor while precluding the entry through the first opening into the passageway of material that would materially compromise the free flow of liquid through the passageway. In a first mode of this first example, the liquid conductor body member can include a second opening located at the discharge end of the liquid conductor at the liquid conductor end member in liquid communication with the passageway. A discharge screening element can be located at the second opening and be configured to allow the discharge of liquid through the second opening from the passageway, while both precluding the entry into the passageway at the discharge end of the liquid conductor of material that would materially compromise the free flow of liquid through the passageway and limiting an access for pests to enter the passageway at the second opening. In a first type of this first mode, the entry screening element can be releasably attachable at the liquid conductor body member at the entry end of the liquid conductor and the discharge screening element can be releasably attachable at the liquid conductor end member at the discharge end of the liquid conductor.

In a second type of the foregoing first mode of the first example of the fourth embodiment of the first aspect, the liquid conductor body member can include an open bottom and be configured to rest at least in part on a surface that extends from the first side of the barrier beneath the barrier to the second side of the barrier. In that case the surface can comprise the bottom portion of the passageway defined at least in part by the liquid conductor body member. A portion of the liquid conductor body member and the passageway can be configured to extend beyond an outer boundary of the surface at the second side of the barrier, whereby the liquid conductor end member releasably attachable to the liquid conductor body member can be located beyond the outer boundary of the surface at the second side of the barrier. The liquid conductor end member can include a closure element, the length of which can be adjusted, and the closure member can be configured to close off the bottom portion of the passageway that extends beyond the outer boundary of the surface at the second side of the barrier. In one form of this second type of the foregoing first mode, the barrier can comprise a base rail to which a screen of a screened-in enclosure is attached.

In a fifth embodiment of the first aspect, the liquid conductor can comprise a plurality of modular sections that are releasably attachable to one another. And in a first example of the sixth embodiment of the first aspect, the plurality of modular sections can be of a configuration and be arranged with respect to one another so that the entry end of the liquid conductor is offset from the discharge end of the liquid conductor, whereby the passageway includes at least one bend.

In a second aspect, a liquid draining structure can be configured to pass a liquid along a surface from a first side of a barrier through the barrier to a second side of the barrier. The liquid draining structure can include a liquid conductor that is configured to rest on the surface, and the liquid conductor can include an entry end that is configured to be located at the first side of the barrier and a discharge end that is configured to be located at the second side of the barrier beyond an outer boundary of the surface. The liquid conductor can define at least in part a passageway that extends through the liquid conductor from the entry end of the liquid conductor to the discharge end of the liquid conductor through which the liquid can pass from the entry end of the liquid conductor to the discharge end of the liquid conductor through the barrier. The liquid conductor can include an open bottom, whereby the surface can comprise the bottom of the passageway when the liquid conductor rests on the surface so that the liquid can pass through the passageway in contact with the surface.

In a first embodiment of the second aspect, the liquid conductor can be configured to rest at least in part on the surface at the second side of the barrier and a portion of each of the liquid conductor and the passageway can be configured to extend beyond an outer boundary of the surface at the second side of the barrier. A closure element, the length of which can be adjusted, can be configured to close off the bottom portion of the passageway that extends beyond the outer boundary of the surface at the second side of the barrier.

In a second embodiment of the second aspect, the liquid draining structure can include a securing member that can be releasably attachable to the liquid conductor at any one of a plurality of positions between the entry end and the discharge end of the liquid conductor at the second side of the barrier. The securing member can be configured to engage the barrier at the second side of the barrier, thereby preventing the movement of the liquid conductor in a direction from the second side of the barrier toward the first side of the barrier when the securing member engages the barrier at the second side of the barrier.

In a first example of the second embodiment of the second aspect, the securing member can be configured to be attached to the barrier at the second side of the barrier. This attachment is configured to maintain the liquid conductor in place and to prevent the movement of the liquid conductor both in a direction from the second side of the barrier toward the first side of the barrier and in a direction from the first side of the barrier to the second side of the barrier when the securing member is attached to the barrier at the second side of the barrier.

In a second example of the second embodiment of the second aspect, the liquid draining structure can include a flange that is secured at the entry end of the liquid conductor. The flange can be configured to engage the barrier at the first side of the barrier, thereby preventing the movement of the liquid conductor in a direction from the first side of the barrier towards the second side of the barrier when the flange engages the barrier at the first side of the barrier. In a first mode of this second example, the securing member can be configured to be attached to the barrier at the second side of the barrier. In that case, the liquid conductor is maintained in place and prevents the movement of the liquid conductor both in a direction from the second side of the barrier toward the first side of the barrier and in a direction from the first side of the barrier to the second side of the barrier when the securing member is attached to the barrier at the second side of the barrier.

In a third embodiment of the second aspect, the liquid conductor can include a first opening that can be located at the entry end of the liquid conductor in liquid communication with the passageway. An entry screening element can be located at the first opening and be configured to allow the entry of liquid through the first opening from the first side of the barrier into the passageway at the entry end of the liquid conductor while precluding the entry through the first opening into the passageway of material that would materially compromise the free flow of liquid through the passageway.

In a first example of the third embodiment of the second aspect, the liquid conductor can include a second opening located at the discharge end of the liquid conductor in liquid communication with the passageway. A discharge screening element can be located at the second opening and be configured to allow the discharge of liquid through the second opening from the passageway while both precluding the entry into the passageway at the discharge end of the liquid conductor of material that would materially compromise the free flow of liquid through the passageway and limiting an access for pests to enter the passageway at the second opening. In a first mode of this first example, the entry screening element can be releasably attachable at the entry end of the liquid conductor.

In a fourth embodiment of the second aspect, the liquid conductor can include a liquid conductor body member that defines at least in part the passageway and a liquid conductor end member. The liquid conductor body member can include a body member first end and a body member second end. The body member first end can include the entry end of the liquid conductor, and the liquid conductor end member can be releasably attachable to the body member second end and include the discharge end of the liquid conductor.

In a first example of the fourth embodiment of the second aspect, the liquid conductor body member can include a first opening located at the entry end of the liquid conductor in liquid communication with the passageway. An entry screening element can be located at the first opening and be configured to allow the entry of liquid through the first opening from the first side of the barrier into the passageway at the entry end of the liquid conductor while precluding the entry through the first opening into the passageway of material that would materially compromise the free flow of liquid through the passageway. In a first mode of this first example of the fourth embodiment, the liquid conductor can include a second opening that is located at the discharge end of the liquid conductor at the liquid conductor end member and is in liquid communication with the passageway. A discharge screening element can be located at the second opening and be configured to allow the discharge of liquid through the second opening from the passageway while both precluding the entry into the passageway at the discharge end of the liquid conductor of material that would materially compromise the free flow of liquid through the passageway and limiting an access for pests to enter the passageway at the second opening. In a first type of this first mode, the entry screening element can be releasably attachable in a fixed position at the liquid conductor body member at the entry end of the liquid conductor, and the discharge screening element can be releasably attachable at the liquid conductor end member at the discharge end of the liquid conductor. And in a second type of this first mode, the liquid conductor body member can be configured to rest at least in part on the surface at the second side of the barrier and a portion of each of the liquid conductor body member and the passageway can be configured to extend beyond an outer boundary of the surface at the second side of the barrier. A closure element, the length of which can be adjusted, can be configured to close off the bottom portion of the passageway that extends beyond the outer boundary of the surface at the second side of the barrier. And in one form of this second type of the first mode, the barrier can comprise a base rail to which a screen of a screened-in enclosure is attached.

In a fifth embodiment of the second aspect, the liquid conductor can comprise a plurality of modular sections that are releasably attachable to one another. And in a first example of the fifth embodiment of the second aspect, the plurality of modular sections can be of a configuration and be arranged with respect one another so that the entry end of the liquid conductor is offset from the discharge end of the liquid conductor, whereby the passageway includes at least one bend.

In a third aspect, a liquid draining structure can be configured to pass a liquid from a first side of a barrier through the barrier to a second side of the barrier. The liquid draining structure can include a liquid conductor that includes an entry end that is configured to be located at the first side of the barrier and a discharge end that is configured to be located at the second side of the barrier. The liquid conductor can define at least in part a passageway that extends through the liquid conductor through which the liquid can pass from the entry end of the liquid conductor to the discharge end of the liquid conductor through the barrier. The liquid conductor can comprise a plurality of modular sections that are releasably attachable to one another. Each releasably attachable modular section can be configured to be of a length so that when the plurality of releasably attachable modular sections are attached to one another, the total length of the plurality of releasably attachable modular sections is such that the entry end of the liquid conductor is configured to be in place at the first side of the barrier and the discharge end of the of the liquid conductor is configured to be in place at the second side of the barrier. An entry end flange that can be integral with a releasably attachable modular section adjacent the first side of the barrier can be configured to be located at the entry end of the liquid conductor and to engage the barrier at the first side of the barrier, thereby preventing the movement of the liquid conductor in a direction from the first side of the barrier toward the second side of the barrier. A discharge end flange that can be integral with a releasably attachable modular section adjacent the second side of the barrier can be configured to be located at the discharge end of the liquid conductor and to engage the barrier at the second side of the barrier, thereby preventing the movement of the liquid conductor in a direction from the second side of the barrier toward the first side of the barrier.

In a first embodiment of the third aspect, the liquid conductor can be configured to rest at least in part on a surface that extends from the first side of the barrier to the second side of the barrier and includes an open bottom, whereby the surface comprises a bottom portion of the passageway defined at least in part by the liquid conductor.

In a second embodiment of the third aspect, the liquid conductor can include a first opening that is located at the entry end of the liquid conductor and is in liquid communication with the passageway. An entry screening element can be located at the first opening and can be configured to allow the entry of liquid through the first opening from the first side of the barrier into the passageway at the entry end of the liquid conductor while precluding the entry through the first opening into the passageway of material that would materially compromise the free flow of liquid through the passageway.

In a first example of the second embodiment of the third aspect, the liquid conductor can include a second opening that is located at the discharge end of the liquid conductor and is in liquid communication with the passageway. A discharge screening element can be located at the second opening and be configured to allow the discharge of liquid through the second opening from the passageway while both precluding the entry into the passageway at the discharge end of the liquid conductor of material that would materially compromise the free flow of liquid through the passageway and limiting the access for pests to enter the passageway at the second opening. In a first mode of this first example, the entry screening element can be releasably attachable at the entry end of the liquid conductor and the discharge screening element can be releasably attachable at the discharge end of the liquid conductor. In one type of this first mode, the barrier can comprise a base rail to which a screen of a screened-in enclosure is attached.

In a second example of the second embodiment of the third aspect, the liquid conductor can include a second opening located at the discharge end of the liquid conductor in liquid communication with the passageway. The second opening can alternatively include a releasably attachable discharge screening element that can be configured to allow the discharge of liquid through the second opening from the passageway while both precluding the entry into the passageway at the discharge end of the liquid conductor of material that would materially compromise the free flow of liquid through the passageway and limiting the access for pests to enter the passageway at the second opening and a releasably attachable closure element that can be configured to close off the second opening.

Any one of the aspects, embodiments, examples, modes, types or forms described above not only can be provided alone, but also can be provided in combination with one or more of the other aspects, embodiments, examples, modes, types or forms.

BRIEF DESCRIPTION OF THE DRAWINGS

The foregoing and other aspects, embodiments and examples of the present invention will be apparent to those skilled in the art to which the invention pertains from the detailed descriptions that follow with reference to the accompanying drawings, wherein the same reference numerals are used in the several figures to refer to the same parts or elements and in which:

FIG. 6 is a perspective view of a portion of the aspect of FIG. 1 that illustrates the structure of a first component of that aspect by means of which the first component and a second component are secured to one another;

FIG. 7 is a cross-sectional view through line 7-7 of FIG. 6;

FIG. 8 is a front elevational view of a third component of the aspect of FIG. 1;

FIG. 9 is a cross-sectional view through line 9-9 of FIG. 8;

DETAILED DESCRIPTION

Aspects of the present invention and embodiments and examples that relate to one or more of the aspects are described below with relevant references to the accompanying drawings. These aspects, embodiments and examples are not intended to be limitations on the preset invention. Thus, for example, in some instances one or more embodiments or examples of the present invention described with reference to one aspect can be utilized in other aspects. In addition, certain terminology is used herein for convenience only and is not to be taken as limiting the present invention.

Figure 1:
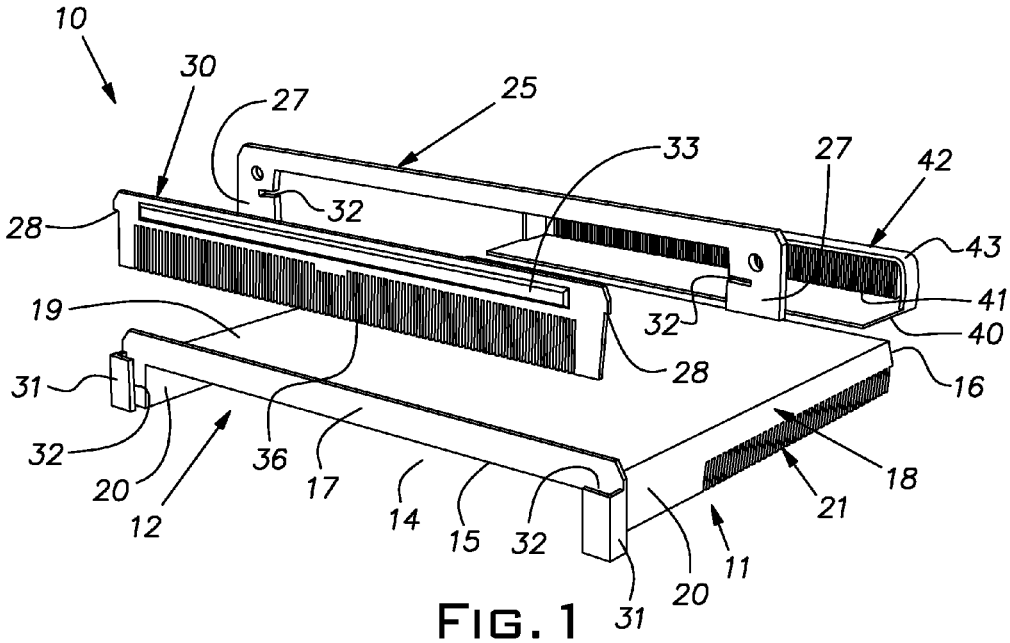
FIG. 1 is a perspective view of an aspect of a liquid draining structure shown in a disassembled state.
Figure 2:
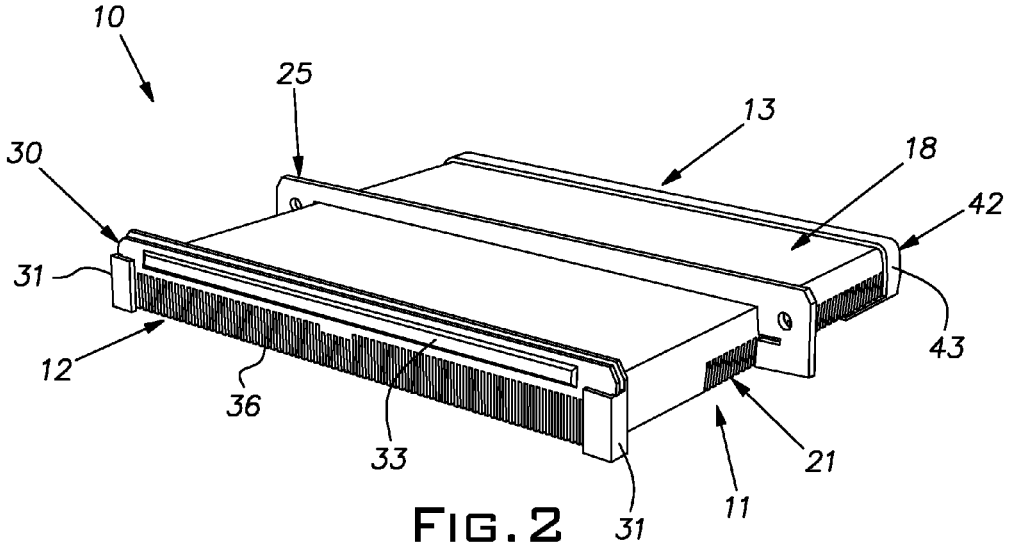
FIG. 2 is a perspective view of the aspect of FIG. 1 shown in an assembled state.

FIG. 1 comprises a disassembled view of a liquid draining structure, indicated generally at 10, according to one aspect of the present invention, and FIG. 2 comprises an assembled view of the liquid draining structure 10. The liquid draining structure 10 includes a liquid conductor, indicated generally at 11, that includes an entry end, indicated generally at 12, and a discharge end, indicated generally at 13. The liquid conductor 11 defines, at least in part, a passageway 14 extending through the liquid conductor 11 from the entry end 12 of the liquid conductor 11 to the discharge end 13 of the liquid conductor 11 through which liquid can pass through a barrier from the entry end 12 of the liquid conductor 11 to the discharge end 13 of the liquid conductor 11. The liquid draining structure 10 also includes a securing member, indicated generally at 25, that is releasably attachable to the liquid conductor 11 at any one of a plurality of positions along an attaching structure, indicated generally at 21, that is located at the liquid conductor 11 between the entry end 12 and the discharge end 13 of the liquid conductor 11. As described below, the securing member 25 serves to secure the liquid draining structure 10 in place at the barrier.

The liquid conductor 11 includes a liquid conductor first opening 15 located at the entry end 12 of the liquid conductor 11 in liquid communication with the passageway 14. An entry screening element, indicated generally at 30, is located at the liquid conductor first opening 15 when the liquid draining structure 10 is assembled, and the entry screening element 30 is configured to allow the entry of liquid through the liquid conductor first opening 15 while precluding the entry through the liquid conductor first opening 15 into the passageway 14 of material that would materially compromise the free flow of liquid through the passageway 14. The liquid conductor 11 also includes a liquid conductor second opening 16 that is located at the discharge end 13 of the liquid conductor 11 and is in liquid communication with the passageway 14. Liquid entering the liquid conductor first opening 15 and conveyed through the passageway 14 is discharged from the liquid conductor 11 at the discharge end 13 of the liquid conductor 11 through the liquid conductor second opening 16. A discharge screening element 41 is located at the liquid conductor second opening 16 and is configured to allow the discharge of the liquid through the liquid conductor second opening 16 from the passageway 14 while both precluding the entry into the passageway 14 at the discharge end 13 of the liquid conductor of material that would materially compromise the free flow of liquid through the passageway 14 and limiting an access for pests to enter the passageway 14 at the second opening 16. As discussed in greater detail below, the entry screening element 30 is releasably attachable at the entry end 12 of the liquid conductor 11 and the discharge screening element 41 is releasably attachable at the discharge end 13 of the liquid conductor 11.

The liquid draining structure 10 includes a flange 17 that is secured at the entry end 12 of the liquid conductor 11 across the top and along the sides of the liquid conductor first opening 15. The flange 17, in cooperation with the securing member 25, aids in maintaining the liquid draining structure 10 in place at the barrier through which the liquid conductor 11 extends as discussed below.

Figure 5:
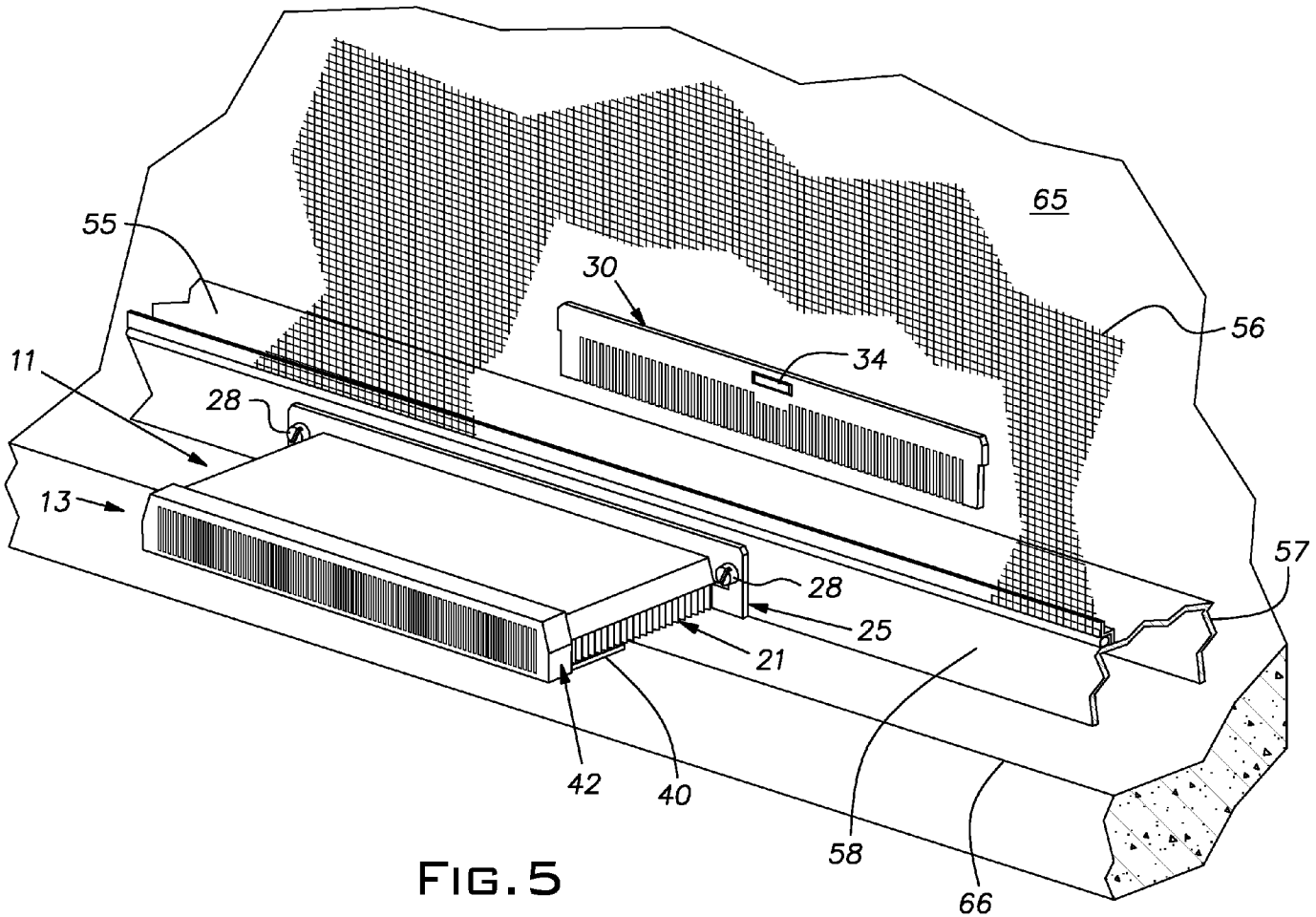
FIG. 5 is a perspective view of the aspect of FIG. 1 shown essentially completely installed at the barrier of the enclosure as seen from the exterior of the enclosure.

A respective L-shaped member 31 is attached to the flange 17 at each side of the liquid conductor first opening 15 so as to provide a respective slot 32 at each side of the liquid conductor 11. When the liquid draining structure 10 is assembled, as shown in FIG. 2, opposite ends of the entry screening element 30 are contained within respective ones of the slots 32. The entry screening element 30 is restrained from passing entirely downwardly through the slots 32 by the engagement with a respective one of the L-shaped members 31 of respective shoulders 28 provided at opposite ends of the entry screening element 30. Concurrently, the entry screening element 30 is restrained from being easily jostled, for example, upwardly and displaced from the slots 32-32 by a restraining lug 34 that is located adjacent the top of the entry screening element 30 at the side of the entry screening element 30 that faces the flange 17 as best seen in FIGS. 5 and 11.

When the entry screening element 30 is in place within the slots 32 across the liquid conductor first opening 15, the restraining lug 34 is located beneath the flange 17 and extends into the passageway 14 past the liquid conductor first opening 15. Consequently, should a force be applied tending to move the entry screening element 30 upwardly, the restraining lug 34 will engage the underside of the flange 17, and the entry screening element 30 will be restrained in place within the slots 32. However, the entry screening element 30 is sufficiently flexible that it can be bent outwardly away from the liquid conductor first opening 15 sufficiently to enable the restraining lug 34 to clear the underside of the flange 17 so that the entry screening element 30 can be withdrawn from the slots 32 if desired. Although not required, an enlargement 33 of the entry screening element 30 can be provided across the entry screening element adjacent the top of the entry screening element as a strengthening element for the purpose of providing additional rigidity to the entry screening element 30.

For the purpose of allowing liquid to enter the liquid conductor first opening 15 and proceed through the passageway 14, while precluding the entry through the liquid conductor first opening 15 into the passageway 14 of material that would materially compromise the free flow of liquid through the passageway, the entry screening element 30 includes, for example, a plurality of vertically arranged members 36. The vertically arranged members 36 are spaced apart an appropriate distance so as to allow the passage of a liquid through the entry screening element 30 but not at such a distance as to allow for the passage of materials that could undesirably interfere with the movement of the liquid through the passageway 14. It will be understood that other types of screening structures can be provided at the entry screening element 30 as well.

Figure 10:
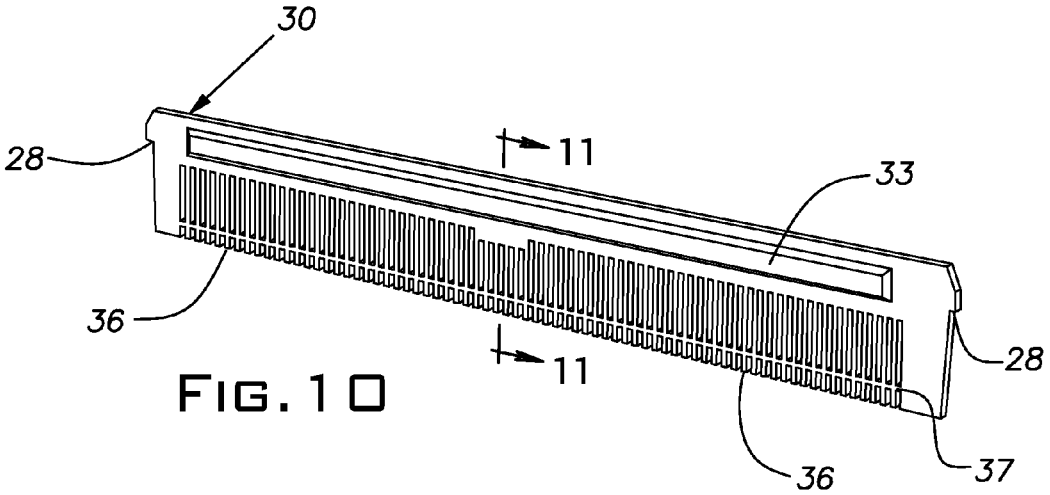
FIG. 10 is a perspective view of a modified version of a component of the embodiment of the liquid draining structure shown in FIG. 1.
Figure 11:
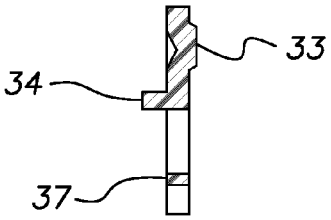
FIG. 11 is a cross-sectional view through line 11-11 of FIG. 10.

Another example of the entry screening element 30 is shown in FIGS. 10 and 11. In that example, the vertically arranged members 36 are joined to one another adjacent their bottoms by a joining member 37. The joining of the vertically arranged members 36 in this way provides additional stability to the vertically arranged members.

The liquid conductor 11, in the aspect of FIG. 1, includes a liquid conductor body member, indicated generally at 18, and a liquid conductor end member indicated generally at 42. The liquid conductor body member 18 includes a top wall 19 and opposite side walls 20-20. Thus, the liquid conductor body member 18 is in the form of a conduit and comprises the portion of the liquid conductor 11 that defines, at least in part, the passageway 14. The liquid conductor body member 18 includes a body member first end that in the example of FIGS. 1 and 2 also comprises the entry end 12 of the liquid conductor 11 and a body member second end that in the example of FIGS. 1 and 2 also comprises the discharge end 13 of the liquid conductor 11. The liquid conductor body member 18 also includes a body member first opening that is located at the body member first end that in the example of FIGS. 1 and 2 also comprises the liquid conductor first opening 15 of the liquid conductor 11. The entry screening element 30 is located at the body member first opening and is releasably attachable at the liquid conductor body member 18 at the entry end 12 of the liquid conductor 11 so that the body member first opening is configured to allow the entry of liquid through the body member first opening into the passageway 14 while precluding the entry through the body member first opening into the passageway 14 of material that would compromise the free flow of liquid through the passageway. The liquid conductor body member 18 additionally includes a body member second opening at the body member second end that in the example of FIGS. 1 and 2 also comprises the liquid conductor second opening 16 of the liquid conductor 11. The liquid conductor end member 42, which includes both the discharge screening element 41 and a closure element 40, is releasably attachable to the body member second end. More specifically, the discharge screening element 41 can be said to be releasably attachable at the discharge end 13 of the liquid conductor 11. The discharge screening element 41 is located at the body member second opening and is configured to allow the discharge of liquid through the body member second opening from the passageway 14 while precluding the entry into the passageway 14 at the discharge end 13 of the liquid conductor 11 and the body member second opening of the liquid conductor body member 42 of material that would materially compromise the free flow of liquid through the passageway 14 and limiting an access for pests to enter the passageway at the body member second opening. The function of the closure element 40 is described below.

Figure 3:
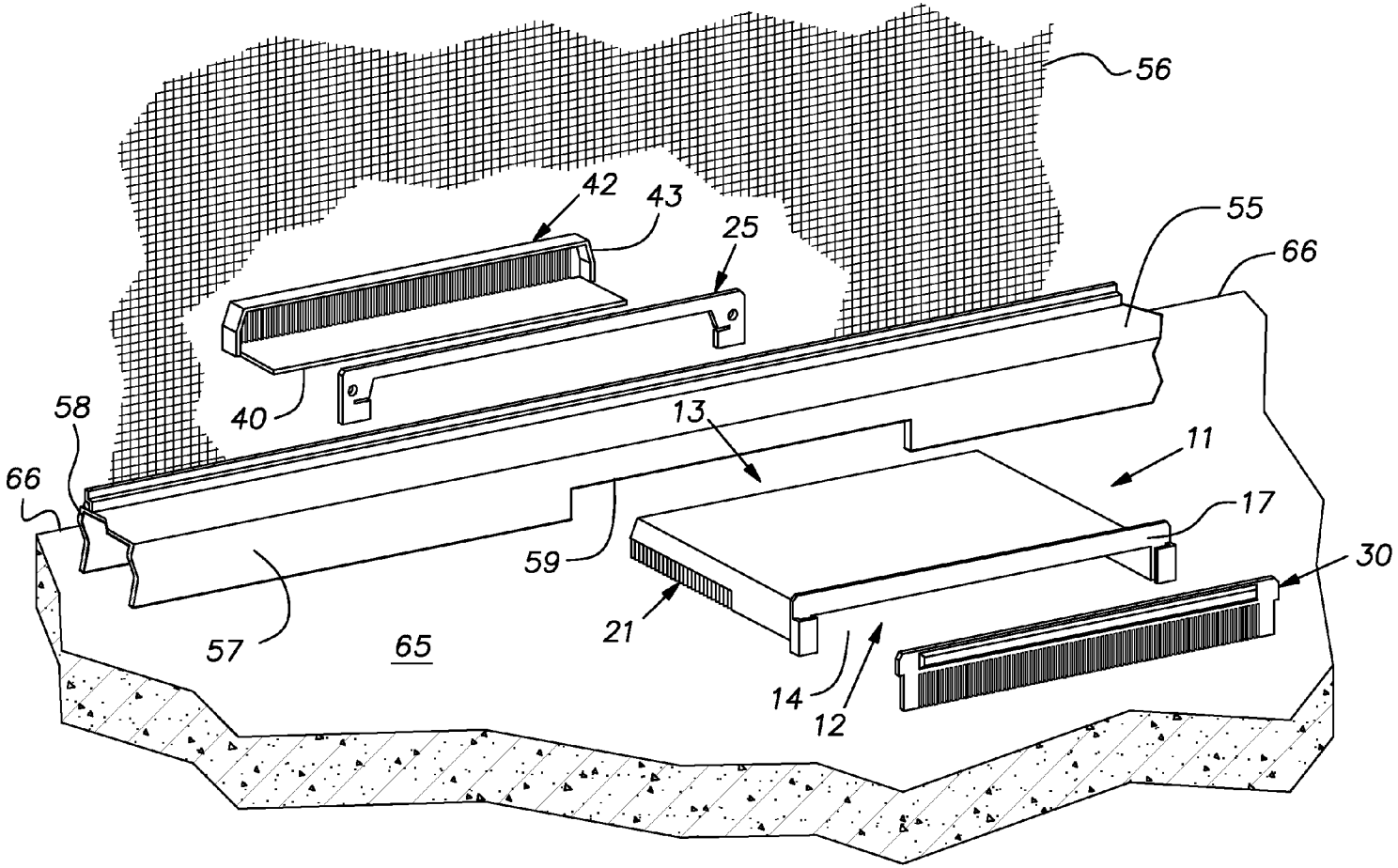
FIG. 3 is a perspective view of the aspect of FIG. 1 shown disassembled preparatory to being installed at the barrier of an enclosure.
Figure 4:
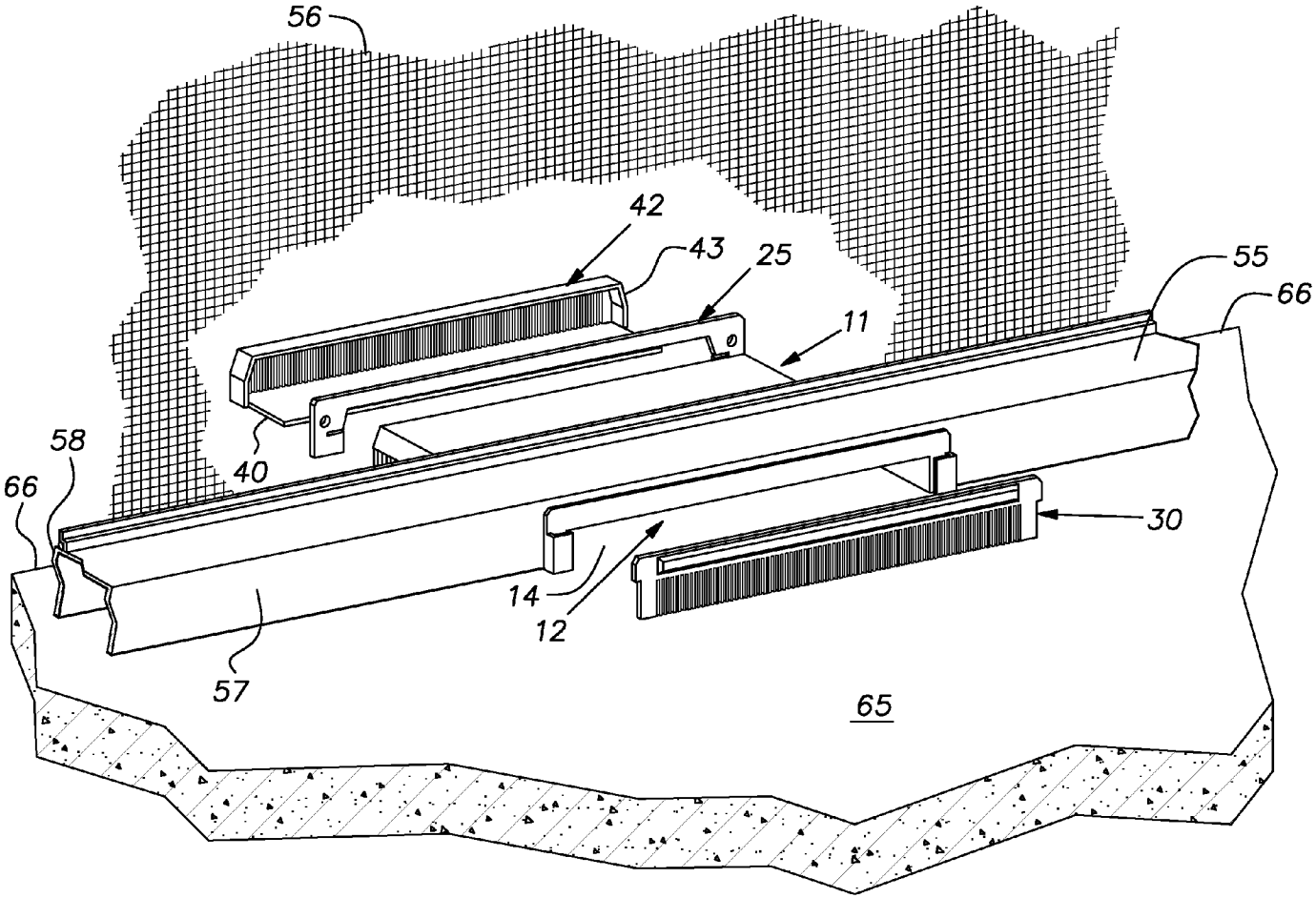
FIG. 4 is a perspective view of the aspect of FIG. 1 shown partially installed at the barrier of the enclosure as seen from the interior of the enclosure.

Referring to FIGS. 3, 4 and 5, the aspect of the liquid draining structure described above is shown preparatory to being installed at a barrier 55 (FIG. 3), partially installed at the barrier 55 (FIG. 4) and essentially completely installed at the barrier 55 (FIG. 5). As shown in FIGS. 3, 4 and 5, the liquid draining structure 10 is configured to pass a liquid from a first side 57 of the barrier 55 through the barrier to a second side 58 of the barrier 55. More specifically, the entry end 12 of the liquid conductor 11, when the liquid draining structure 10 is installed, is configured to be located at the first side 57 of the barrier 55 and the discharge end 13 of the liquid conductor 11 is configured to be located at the second side 58 of the barrier 55. The passageway 14, defined at least in part by the liquid conductor 11 and extending from the entry end 12 of the liquid conductor 11 to the discharge end 13 of the liquid conductor, provides a passageway through which the liquid can pass from the entry end 12 of the liquid conductor 11 to the discharge end 13 of the liquid conductor 11 through the barrier 55.

In the embodiment illustrated in FIGS. 3, 4 and 5, the liquid draining structure 10 is shown as located at a barrier 55 that comprises a base rail to which a screen 56 of a screened-in enclosure is attached. The base rail is attached to the surface 65 of a floor of the enclosure. As previously discussed, water can collect on the surface 65 at the interior of the screened-in enclosure as a result, for example, of rain water entering the enclosure through the openings in the screen 56. Because the screen walls of the enclosure are supported at the surface 65 of the floor of the enclosure by the rails attached to the floor, the rails present a barrier to the easy removal of the water that can collect at the surface of the floor. The present invention in its various aspects, embodiments and examples allows for the ready disposal of such collected water by providing a passageway through which the water can be conveyed from the interior of the enclosure to the exterior of the enclosure through the barrier 55 in the form of base rails that support the screen walls of the enclosure. Although the aspect of the invention illustrated in the drawings is described herein with reference to its application to screened-in enclosures, it will be understood that the invention can be applied in other contexts and circumstances at which it is desired to pass a liquid through a barrier.

As noted, FIG. 3 illustrates the liquid draining structure 10 in an attitude set for installation at the barrier 55. Thus, the liquid conductor 11 and the entry screening element 30 are positioned at the first side 57 of the barrier 55, and the securing member 25 and the liquid conductor end member 42 are positioned at the second side 58 of the barrier 55 at a barrier opening 59 that is provided through the barrier 55 and at which the liquid draining structure 10 is to be installed.

The outer dimensions of the flange 17 that is secured at the entry end 12 of the liquid conductor 11 are larger than the dimensions of the opening 59 in the barrier 55. As a result, the flange 17 is configured to engage the barrier 55 at the first side 57 of the barrier when the liquid conductor 11 is inserted through the opening 59, thereby preventing the movement of the liquid conductor 11 in a direction from the first side 57 of the barrier towards the second side 58 of the barrier when the flange 17 engages the barrier 55 at the first side 57 of the barrier as best seen in FIG. 4.

As shown in FIG. 5, the securing member 25, which is releasably attachable to the liquid conductor 11, and more particularly to the liquid conductor body member 18, at any one of a plurality of positions at the attaching structure 21 at the liquid conductor 11, is configured to engage the barrier 55 at the second side 58 of the barrier, thereby preventing the movement of the liquid conductor 11 in a direction from the second the second side 58 of the barrier 55 toward the first side 57 of the barrier when the securing member 25 engages the barrier at the second side of the barrier. More specifically, as shown in the example of FIGS. 6 and 7, the attaching structure 21 at the liquid conductor body member 18 of the liquid conductor 11 can comprise a continuum of notched projections 22 that are substantially triangular in shape in cross-section. At the same time, the securing member 25, as best seen in FIG. 1, can be provided with a respective point of weakness 32 at each of securing member opposed legs 27 of the securing member 25, thereby imparting flexibility to the securing member opposed legs 27. The securing member 25 can be placed down onto the liquid conductor body member 18 of the liquid conductor 11 so that the liquid conductor body member 18 is received in the opening of the securing member 25 between the securing member opposed legs 27 and the opposed legs engage the attaching structure 21 at the liquid conductor body member 18 of the liquid conductor 11. Thereafter, the securing member 25 can be advanced along the liquid conductor body member 18 while the securing member opposed legs 27 move over the notched projections 22 until the securing member 25 engages the barrier 55 at the second side 58 of the barrier. The securing member 25 is secured at that location by the engagement of the securing member opposed legs 27 with the attaching structure 21 between respective adjacent notched projections 22. The securing member 25 can be additionally secured to the barrier 55 at the second side 58 of the barrier by the use of fasteners or adhesive for example. In the example of FIG. 5, such an additional securement is provided by the screws 28 that pass through the securing member 25 and are screwed to the barrier 55.

As best seen in FIG. 4, the liquid conductor 11, and more specifically the liquid conductor body member 18, includes an open bottom and is configured to rest at least in part on the surface of the floor 65 that extends from the first side 57 of the barrier 55 beneath the barrier to the second side 58 of the barrier 55 to an outer boundary 66 of the surface of the floor 65 at the second side 58 of the barrier 55. Thus, the surface of the floor 65 comprises a bottom portion of the passageway 14. As best seen in FIG. 5, a portion of the liquid conductor 11, including the discharge end 13 of the liquid conductor 11, and more particularly a portion of the liquid conductor body member 18, as well as portion of the passageway 14, are configured to extend beyond the outer boundary 66 of the surface of the floor 65 at the second side 58 of the barrier 55. Thus, the discharge end 13 of the liquid conductor 11 is configured to be located at the second side of the barrier beyond the outer boundary 66 of the surface so that the liquid conductor 11 defines at least in part a passageway 14 that extends through the liquid conductor 11 from the entry end 12 of the liquid conductor to the discharge end 13 of the liquid conductor through which the liquid can pass from the entry end 12 of the liquid conductor 11 through the barrier 55 to the discharge end 13 of the liquid conductor 11 beyond the outer boundary 66 of the surface of the floor 65.

The liquid conductor end member 42, including the closure element 40, removably attachable to the discharge end 13 of the liquid conductor 11, is located beyond the outer boundary 66 of the surface 65 at the second side of the barrier 58. The closure element 40 is configured to close off the bottom of the passageway 14 that extends beyond the outer boundary 66 of the surface 65 at the second side of the barrier 58.

The installation of the liquid draining structure 10 also involves situating in place at the discharge end 13 of the liquid conductor 11 the liquid conductor end member 42. For this purpose, a liquid conductor end member housing 43 is provided internally with several flanges that, as shown in FIGS. 8 and 9, cooperate with the interior surfaces of the housing top wall 44 and the housing side walls 45 of the liquid conductor end member housing 43 to provide slots into which the perimeter of the liquid conductor body member 18 at the discharge end 13 can be inserted. Specifically, with reference to FIGS. 8 and 9, a first flange 46 is provided internally of the liquid conductor end member housing 43 substantially horizontally between the housing side walls 45 and slightly below the housing top wall 44 of the liquid conductor end member housing 43 to form a substantially horizontal slot 47. Each of the opposed ends of the first flange 46 includes a respective portion that is directed downwardly within the liquid conductor end member housing 43 to provide a respective first vertical slot 48. In addition, opposed second vertical flanges 49 are provided within the liquid conductor end member housing 43 adjacent the bottom of respective housing side walls 45 to form respective second vertical slots 50. The substantially horizontal slot 47, the first vertical slots 48 and the second vertical slots 50 are each substantially as wide as the thickness of the shell that comprises the liquid conductor body member 18 and otherwise are substantially dimensionally congruent with the shell of the liquid conductor body member 18. Consequently, the liquid conductor end member 42 can be mounted on the liquid conductor body member 18 by inserting the edge of the top wall 19 of the liquid conductor body member 18 into the substantially horizontal slot 47 and the sides 20-20 of the liquid conductor body member 18 into respective ones of the pair of first vertical slots 48 and the pair of the second vertical slots 50.

To facilitate the installation of the liquid draining structure 10 so that the liquid conveyed through the liquid draining structure will be discharged beyond the outer boundary 66 of the surface of the floor 65, the liquid draining structure can be initially composed so that the liquid conductor body member 18 will be of a sufficient length that the discharge end 13 of the liquid conductor 11 will in most, if not all, anticipated circumstances extend beyond the outer boundary 66 of the surface of the floor 62 at which the liquid draining structure 10 is to be installed. Additionally, the closure element 40 of the liquid conductor end member 42 will initially be of a sufficient length that it will in essentially all anticipated circumstances entirely close off the opening of the passageway 14 that extends beyond the boundary 66 of the surface 65 from which the liquid is to be discharged. In order to accommodate the dimensional constraints at essentially every potential installation of the liquid draining structure 10, the lengths of the liquid conductor body member 18 and the closure element 40, as originally composed, can be greater than desired. No difficulty is presented thereby, however, since the lengths of both the liquid conductor body member 18 and the closure element 40 can be shortened by cutting the ends of the liquid conductor body member 18 and the closure element 40 to accommodate the dimensions that exist at any installation.

Figure 13:
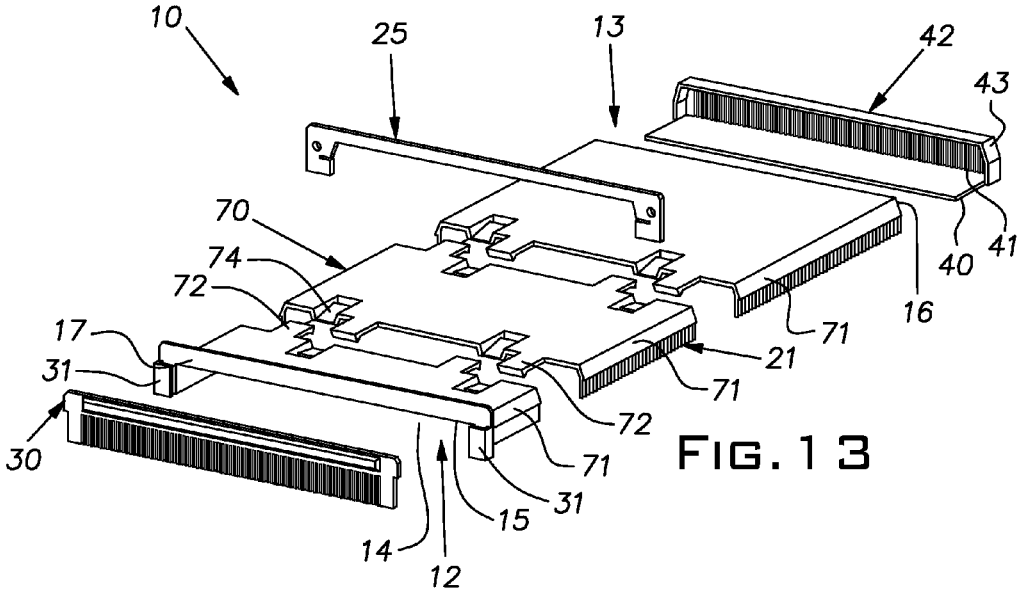
FIG. 13 is a perspective view of an another aspect of a liquid draining structure according to the present invention wherein the liquid draining structure is shown in a disassembled state.
Figure 14:
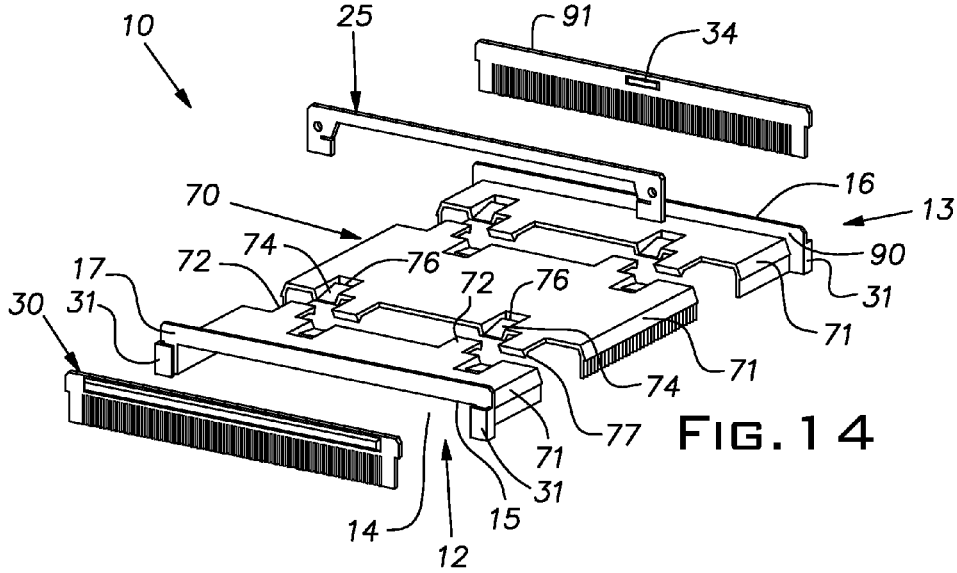
FIG. 14 is a perspective view of a further aspect of a liquid draining structure according to the present invention wherein the liquid draining structure is shown in a disassembled state.
Figure 15:
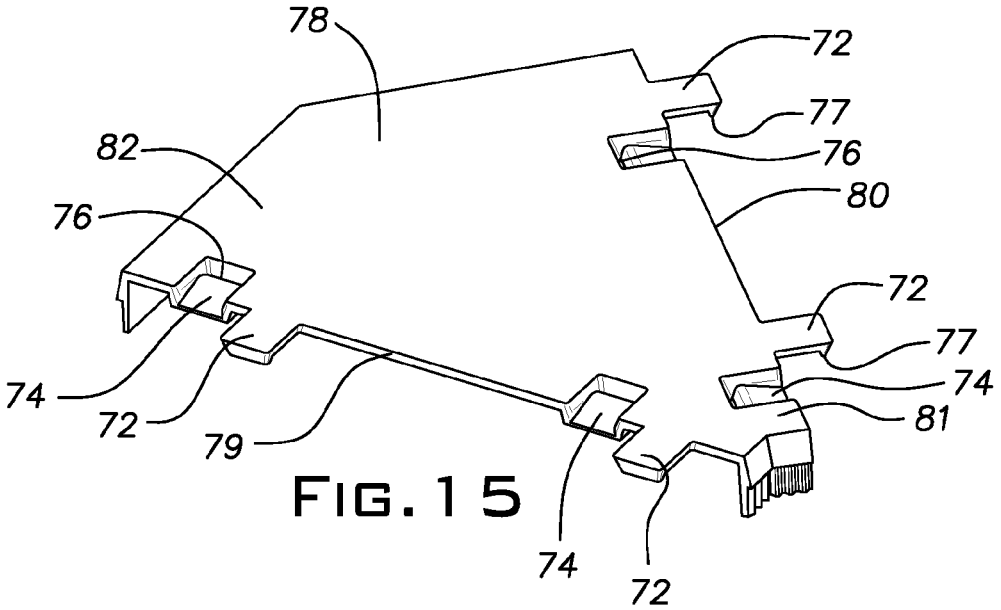
FIG. 15 is a perspective view of a component of a liquid draining structure according to an additional aspect of the present invention.

In the alternate aspects illustrated in FIGS. 13 and 14, a liquid draining structure 10 that is configured to pass a liquid from the first side of a barrier 57 through the barrier 55 to the second side of the barrier 58 includes a modular liquid conductor 70 that comprises a plurality of modular sections 71 that are releasably attachable to one another. As with the embodiment described in FIGS. 1 and 2, the modular liquid conductor 70 includes an entry end 12 that is configured to be located at the first side of the barrier 57 and a discharge end 13 that is configured to be located at the second side of the barrier 58. Also as previously described with respect to the embodiment of FIGS. 1 and 2, the modular liquid conductor 70 has an open bottom and is configured to rest on the surface of the floor 65 and defines at least in part a passageway 14 that extends through the modular liquid conductor 70 through which the liquid can pass through the barrier 55 from the entry end 12 of the modular liquid conductor 70 at the first side of the barrier 57 to the discharge end 13 of the modular liquid conductor 70 which can be located beyond the outer boundary 66 of the surface of the floor 65 at the second side of the barrier 58. The modular liquid conductor 70 is configured to rest at least in part on the surface of the floor 65 that extends from the first side of the barrier 57 to the second side of the barrier 58. The modular liquid conductor 70 includes an open bottom, whereby the surface of the floor 65 comprises a bottom portion of the passageway 14 that is defined at least in part by the modular liquid conductor 70.

Each releasably attachable modular section 71 can be configured to be of a length so that when the plurality of releasably attachable modular sections are attached to one another, the total length of the plurality of releasably attachable modular sections is such that the entry end 12 of the modular liquid conductor 70 is configured to be in place at the first side of the barrier 57 and the discharge end 13 of the of the modular liquid conductor 70 is configured to be in place at the second side of the barrier 58 at a selected location such as beyond the outer boundary 66 of the surface of the floor 65.

The particular modular section 71 that, when installed, is adjacent the first side of the barrier 57 includes the flange 17 that is integral with that particular modular section and is located at the entry end 12 of the modular liquid conductor 70. The flange 17 is configured to engage the barrier 55 at the first side of the barrier 57, as discussed above, thereby preventing the movement of the modular liquid conductor 70 in a direction from the first side of the barrier 57 toward the second side of the barrier 58. Also as discussed above, the securing member 25 is configured to be secured to the attaching structure 21 provided at at least one of the releasably attachable modular sections 71 and to engage the barrier 55 at the second side 58 of the barrier, thereby preventing the movement of the modular liquid conductor 70 in a direction from the second side 58 of the barrier 55 to the first side 57 of the barrier.

The liquid conductor first opening 15 is located at the entry end 12 of the modular liquid conductor 70 and is in liquid communication with the passageway 14. The entry screening element 30 is releasably secured at the flange 17 at the liquid conductor first opening 15 and is configured to allow the entry of liquid through the liquid conductor first opening 15 from the first side of the barrier 57 into the passageway 14 at the entry end 12 of the modular liquid conductor 70 while precluding the entry through the liquid conductor first opening 15 into the passageway 14 of material that would materially compromise the free flow of liquid through the passageway 14. In the example of FIG. 13, the liquid conductor end member 42, including the closure element 40 and the discharge screening element 41, is releasably secured to the particular modular section 71 that is located at the second side of the barrier 58 at the discharge end 13 of the modular liquid conductor 70. The liquid conductor end member 42, through the functioning of the closure element 40 and the discharge screening element 41, is configured to allow the discharge of liquid from the modular liquid conductor 70 at the discharge end 13 of the modular liquid conductor while precluding the entry through the liquid conductor second opening 16 into the passageway 14 of material that would materially compromise the free flow of liquid through the passageway 14 and the entry of pests into the passageway 14. And, as discussed above, the closure element 40 is configured to close off the bottom of the passageway 14 that extends beyond the boundary 66 of the surface 65.

The modular liquid conductor 70 of the example of FIG. 14 is of the same construction as the modular liquid conductor 70 of FIG. 13 except with respect to the construction at the discharge end 13. Specifically, the modular liquid conductor 70 of FIG. 14 includes a discharge end flange 90 that is integral with the modular section 71 that comprises the endmost modular section at the second side of the barrier 58. Thus, the discharge end flange 90 is configured to be located at the discharge end 13 of the modular liquid conductor 70. The construction of the discharge end flange 90, including the inclusion of L-shaped members 31, can be like that of the flange 17 located at the entry end 12 of the modular liquid conductor 70. A modular discharge screening element 91 that can be constructed like the entry screening element 30 is releasably secured to the discharge end flange 90 at the second opening 16 located at the discharge end 13 of the modular liquid conductor 90 in liquid communication with the passageway 14. The modular discharge screening element 91 is configured to allow the discharge of liquid through the second opening 16 from the passageway 14 while both precluding the entry into the passageway 14 at the discharge end 13 of the modular liquid conductor 90 of material that would materially compromise the free flow of liquid through the passageway 14 and limiting the access for pests to enter the passageway 14 at the second opening 16.

While the modular sections 71 of the modular liquid conductor 70 can be secured to one another by any suitable means, in the examples of FIGS. 13 and 14, each modular section 71, at an end that engages an end of an adjacent modular section 71, includes a pair of complementary snap fasteners that are hereafter described with specific reference to FIG. 14.

Each pair of snap fasteners includes a pair of projections 72-72. Each projection of each pair of projections 72-72, is located adjacent a respective side of each modular section 71. Each modular section 71 also includes a pair of recesses 74-74 that are aligned with the pair of projections 72-72 of an abutting modular section 71 and into which the pair of projections 72-72 of the abutting modular section are inserted. Each recess 74 includes a sloping surface, as can be seen in FIGS. 13 and 14, that includes a slot 76 into which a securing portion 77 of a respective projection 72 is inserted so as to secure each projection 72 at a respective recess 74 and, correspondingly, secure adjacent modular sections 71 to one another.

Figure 16:
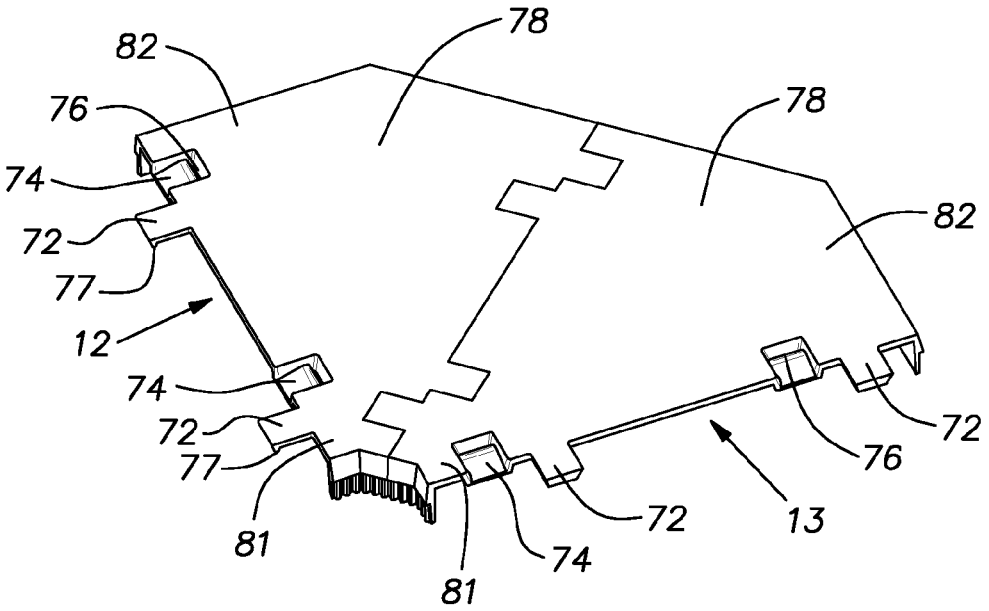
FIG. 16 is a perspective view of two of the components of FIG. 15 having been assembled with one another.

As illustrated in the embodiments of FIGS. 15-18, the plurality of modular sections of the modular liquid conductor 70 can comprise angular modular sections 78 that can be of a configuration and be arranged with respect to one another so that the entry end 12 of the modular liquid conductor 70 is offset from the discharge end 13 of the modular liquid conductor 70. In that case, the passageway 14 through the modular liquid conductor 70 includes at least one bend. In the examples of FIGS. 15-18, each angular modular section 78 extends over, or covers, a 45 degree, wedge-shaped portion of a surface, such as the surface of the floor 65, that extends from an angular modular section first end 79 to an angular modular section second end 80. Two of the angular modular sections can be secured to one another by means of respective pairs of projections 72-72 and pairs of recesses 74, as shown in FIG. 16, with the narrower sides of the angular modular sections 81 secured to one another and the wider sides of the angular modular sections 82 secured to one another to form the modular liquid conductor 70 including an entry end 12 and a discharge end 13. Thus in the arrangement of FIG. 16, liquid passing from the entry end 12 of the modular liquid conductor 70 to and through the discharge end 13 of the modular liquid conductor 70 will take a 90 degree turn in the passageway 14 through the modular liquid conductor 70.

Figure 17:
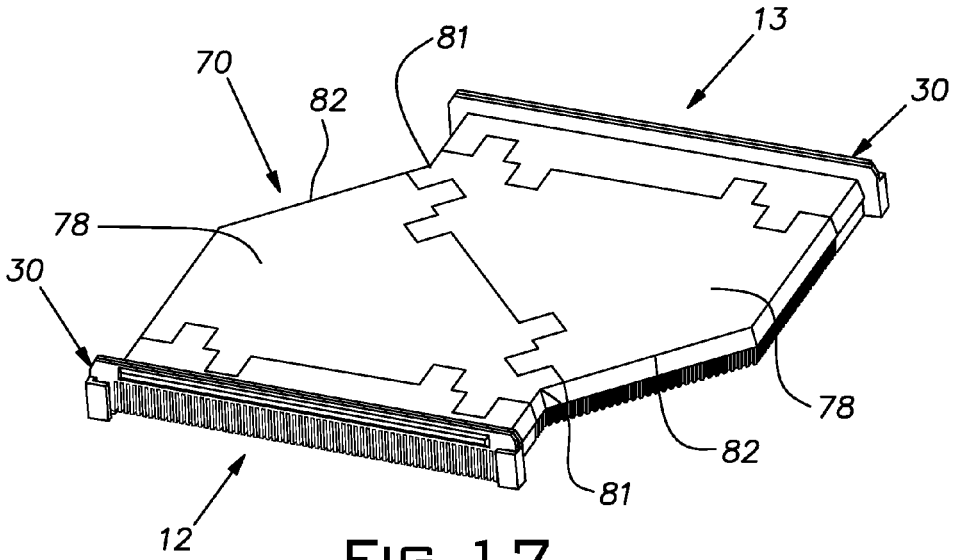
FIG. 17 is a perspective view of a liquid draining structure according to yet another aspect of the invention wherein components of the example of FIG. 15 are employed in a first arrangement in the liquid draining structure.

In the example of FIG. 17, two angular modular sections 78, each of which extends over a 45 degree wedge-shaped portion of a surface, are secured to one another with the narrower side of the angular modular section 81 of each angular modular section 71 secured to the wider side of the angular modular section 82 of the other angular modular section 71 to define the passageway 14 through the resulting modular liquid conductor 70. In this arrangement, the entry end 12 and the discharge end 13 of the modular liquid conductor 70 are offset from one another. As a result, the liquid to be removed from the surface of the floor 65, rather than passing on a straight course from the entry end 12 to the discharge end 13 of the modular liquid conductor 70, will pass through the modular liquid conductor 70 on a course that changes direction in the passageway 14. This type of an arrangement is useful for example when a passageway 14 having a straight course would discharge the liquid at the second side of the barrier 58 at an undesirable location.

The modular section located at the entry end 12 of the modular liquid conductor 70 of the example of FIG. 17 can have the same construction as the construction of the modular section located at the entry end 12 of the modular liquid conductor 70 of FIGS. 13 and 14. And the modular section located at the discharge end 13 of the modular liquid conductor 70 of the example of FIG. 17 can have the same construction as the construction of the modular section located at the discharge end 13 of the modular liquid conductor 70 of FIG. 14.

Figure 18:
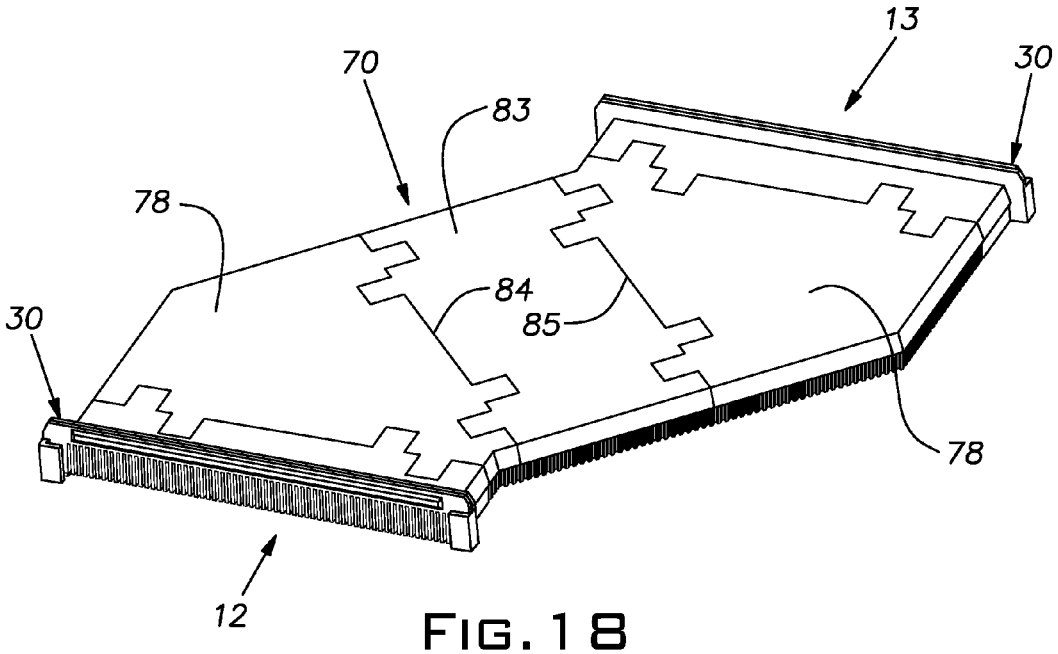
FIG. 18 is a perspective view of a liquid draining structure according to still an additional aspect of the invention wherein components of the example of FIG. 15 are employed in a second arrangement in the liquid draining structure.

In the example of FIG. 18, an intermediate modular section 83 that includes a first end 84 and a second end 85 that are substantially parallel to one another is positioned between and secured to one angular modular section 78 at the first end 84 of the intermediate modular section 83 and to another angular modular section 78 at the second end 85 of the intermediate modular section. The resulting modular liquid conductor 70 provides for a greater degree of offset between the entry end 12 and the discharge end 13 of the modular liquid conductor 70.

Figure 12:
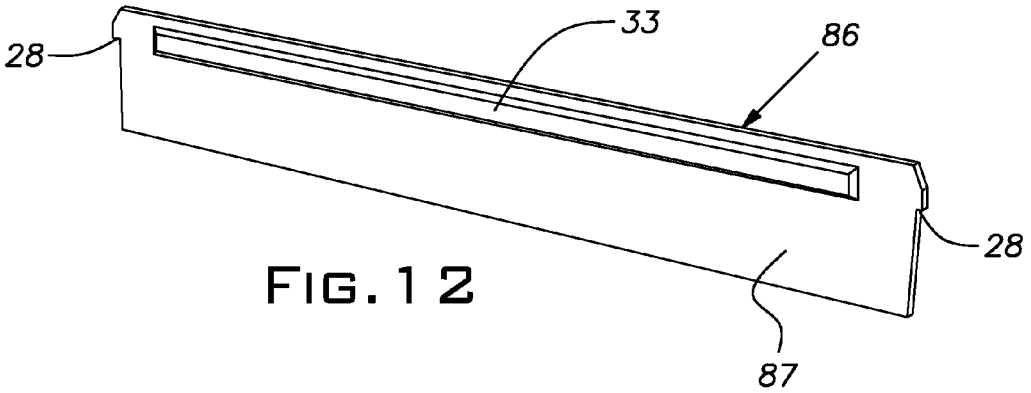
FIG. 12 is a perspective view of an alternative embodiment of a component that can be used with the liquid draining structure of FIG. 1.

Under certain circumstances, it may be desirable to close off the passageway 14 through the liquid draining structure 10. The cause of that desire may be, simply, a preference not to allow an enclosure, at which a liquid draining structure has been installed, to be open to the outside when the liquid draining structure is not in use. Alternatively, for example, it can be the case that the liquid draining structure 10 has been installed at the intersection of a wall and floor of an enclosure that is otherwise not open to the outside environment. And the climate can be such that from time to time immoderate temperatures are experienced. In such a circumstance, there can be a preference to close off the liquid draining structure to the outside air. Those preferences can be satisfied by replacing the entry screening element 30 with the releasably attachable barrier element 86 shown in FIG. 12. The barrier element 86 can be constructed so as to have the same features as the entry screening element 30 except that, in place of the vertically arranged members 36 of the entry screening element 30, the barrier element can be provided a solid portion 87 through which fluids cannot pass.

While the present invention has been described above and illustrated with reference to certain aspects, embodiments and examples thereof, it is to be understood that the invention is not so limited. For example, although examples have been described of certain configurations of modular liquid conductors that can be provided, other configurations employing only angular, only non-angular or combinations of angular and non-angular modular sections will occur to those skilled in the art without departing from the spirit of the present invention as set forth in the claims that follow. In addition, modifications and alterations of the aspects, embodiments and examples of the invention described herein will occur to those skilled in the art upon reading the specification, including the claims, and considering the drawings. The present invention is intended to cover and include any and all such modifications and variations to the described aspects, embodiments and examples that are encompassed by the following claims.

What is claimed is:

1. A liquid draining structure configured to pass a liquid from a first side of a barrier through the barrier to a second side of the barrier, the liquid draining structure including:

a liquid conductor including an entry end, configured to be located at the first side of the barrier, a discharge end, configured to be located at the second side of the barrier, opposite side walls extending between the entry end and the discharge end of the liquid conductor, and a respective attaching structure located at each side wall, each respective attaching structure configured to be located at the second side of the barrier, the liquid conductor defining at least in part a passageway extending through the liquid conductor from the entry end of the liquid conductor to the discharge end of the liquid conductor through which the liquid can pass from the entry end of the liquid conductor to the discharge end of the liquid conductor through the barrier; and a securing member releasably attachable to each attaching structure at any one of a plurality of positions between the entry end and the discharge end of the liquid conductor at the second side of the barrier, the securing member being configured to be secured in place at each attaching structure at a location at which the securing member engages the barrier at the second side of the barrier, thereby preventing the movement of the liquid conductor in a direction from the second side of the barrier toward the first side of the barrier when the securing member engages the barrier at the second side of the barrier.

2. The liquid draining structure of claim 1 wherein the liquid conductor includes an open bottom and is configured to rest at least in part on a surface that extends from the first side of the barrier beneath the barrier to the second side of the barrier, whereby the surface comprises a bottom portion of the passageway, a portion of each of the liquid conductor, including the discharge end of the liquid conductor, and a portion of the passageway being configured to extend beyond an outer boundary of the surface at the second side of the barrier, and a closure element removably attachable to the discharge end of the liquid conductor and configured to close off the bottom portion of the passageway that is configured to extend beyond the outer boundary of the surface at the second side of the barrier.

3. The liquid draining structure of claim 1 including a flange secured at the entry end of the liquid conductor and configured to engage the barrier at the first side of the barrier, thereby preventing the movement of the liquid conductor in a direction from the first side of the barrier towards the second side of the barrier when the flange engages the barrier at the first side of the barrier.

4. The liquid draining structure of claim 1 wherein the liquid conductor includes:

a liquid conductor first opening located at the entry end of the liquid conductor in liquid communication with the passageway, an entry screening element located at the liquid conductor first opening and configured to allow the entry of liquid through the liquid conductor first opening from the first side of the barrier into the passageway at the entry end of the liquid conductor while precluding the entry through the liquid conductor first opening into the passageway of material that would materially compromise the free flow of liquid through the passageway; and a liquid conductor second opening located at the discharge end of the liquid conductor in liquid communication with the passageway, a discharge screening element located at the liquid conductor second opening and configured to allow the discharge of liquid through the liquid conductor second opening from the passageway while both precluding the entry into the passageway at the discharge end of the liquid conductor of material that would materially compromise the free flow of liquid through the passageway and limiting an access for pests to enter the passageway at the second opening.

5. The liquid draining structure of claim 4 wherein the entry screening element is releasably attachable from the entry end of the liquid conductor, and the discharge screening element is releasably attachable from the discharge end of the liquid conductor.

6. The liquid draining structure of claim 1 wherein the liquid conductor includes a liquid conductor body member, defining at least in part the passageway, and a liquid conductor end member, the liquid conductor body member including a body member first end that comprises the entry end of the liquid conductor and a body member second end that comprises the discharge end of the liquid conductor, the liquid conductor end member being releasably attachable to the body member second end.

7. The liquid draining structure of claim 6 wherein the liquid conductor body member includes:

a body member first opening located at the body member first end and configured to allow the entry of liquid through the body member first opening from the first side of the barrier into the passageway at the entry end of the liquid conductor while precluding the entry through the body member first opening into the passageway of material that would materially compromise the free flow of liquid through the passageway; and a body member second opening located at the discharge end of the liquid conductor at the liquid conductor end member in liquid communication with the passageway, a discharge screening element located at the body member second opening and configured to allow the discharge of liquid through the body member second opening from the passageway while both precluding the entry into the passageway at the discharge end of the liquid conductor of material that would materially compromise the free flow of liquid through the passageway and limiting an access for pests to enter the passageway at the second opening.

8. The liquid draining structure of claim 7 wherein the entry screening element is releasably attachable at the liquid conductor body member at the entry end of the liquid conductor, and the discharge screening element is releasably attachable at the liquid conductor end member at the discharge end of the liquid conductor.

9. The liquid draining structure of claim 7 wherein the liquid conductor body member includes an open bottom and is configured to rest at least in part on a surface that extends from the first side of the barrier beneath the barrier to an outer boundary at the second side of the barrier, whereby the surface comprises the bottom portion of the passageway defined at least in part by the liquid conductor body member, a portion of the liquid conductor body member and the passageway being configured to extend beyond the outer boundary of the surface at the second side of the barrier, whereby the liquid conductor end member is located beyond the outer boundary of the surface at the second side of the barrier, the liquid conductor end member including a closure element, the length of which can be adjusted, configured to close off the bottom portion of the passageway that extends beyond the outer boundary of the surface at the second side of the barrier.

10. The liquid draining structure of claim 9 wherein the barrier comprises a base rail to which a screen of a screened-in enclosure is attached.

11. The liquid draining structure of claim 1, wherein the liquid conductor comprises a plurality of modular sections releasably attachable to one another.

12. The liquid draining structure of claim 11 wherein the plurality of modular sections are of a configuration and are arranged with respect to one another so that the entry end of the liquid conductor is offset from the discharge end of the liquid conductor, whereby the passageway includes at least one bend.

13. A liquid draining structure configured to pass a liquid along a surface having an outer boundary from a first side of a barrier through the barrier to a second side of the barrier, the surface including an outer boundary at the second side of the barrier, the liquid draining structure including a liquid conductor configured to rest on the surface and including an entry end, configured to be located at the first side of the barrier on the surface, and a discharge end, configured to be located at the second side of the barrier beyond the outer boundary of the surface, the liquid conductor defining at least in part a passageway extending through the liquid conductor from the entry end of the liquid conductor to the discharge end of the liquid conductor through which the liquid can pass from the entry end of the liquid conductor to the discharge end of the liquid conductor through the barrier and be discharged from the discharge end of the liquid conductor beyond the outer boundary of the surface, the liquid conductor including an open bottom, whereby the surface comprises the bottom of the passageway when the liquid conductor rests on the surface so that the liquid can pass through the passageway in contact with the surface, and a closure element, the length of which can be adjusted, configured to close off the bottom portion of the passageway that extends beyond the outer boundary of the surface at the second side of the barrier.

14. The liquid draining structure of claim 13 including a securing member releasably attachable to the liquid conductor at any one of a plurality of positions between the entry end and the discharge end of the liquid conductor at the second side of the barrier, the securing member being configured to engage the barrier at the second side of the barrier, thereby preventing the movement of the liquid conductor in a direction from the second side of the barrier toward the first side of the barrier when the securing member engages the barrier at the second side of the barrier.

15. The liquid draining structure of claim 14 including a flange secured at the entry end of the liquid conductor and configured to engage the barrier at the first side of the barrier, thereby preventing the movement of the liquid conductor in a direction from the first side of the barrier towards the second side of the barrier when the flange engages the barrier at the first side of the barrier.

16. The liquid draining structure of claim 13 wherein the liquid conductor includes:

a liquid conductor first opening located at the entry end of the liquid conductor in liquid communication with the passageway, an entry screening element located at the liquid conductor first opening and configured to allow the entry of liquid through the liquid conductor first opening from the first side of the barrier into the passageway at the entry end of the liquid conductor while precluding the entry through the liquid conductor first opening into the passageway of material that would materially compromise the free flow of liquid through the passageway; and a liquid conductor second opening located at the discharge end of the liquid conductor in liquid communication with the passageway, a discharge screening element located at the liquid conductor second opening and configured to allow the discharge of liquid through the liquid conductor second opening from the passageway while both precluding the entry into the passageway at the discharge end of the liquid conductor of material that would materially compromise the free flow of liquid through the passageway and limiting an access for pests to enter the passageway at the second opening.

17. The liquid draining structure of claim 16 wherein the entry screening element is releasably attachable at the entry end of the liquid conductor, and the discharge screening element is releasably attachable at the discharge end of the liquid conductor.

18. The liquid draining structure of claim 13 wherein the liquid conductor includes a liquid conductor body member, defining at least in part the passageway, and a liquid conductor end member, the liquid conductor body member including a body member first end that comprises the entry end of the liquid conductor and a body member second end that comprises the discharge end of the liquid conductor, the liquid conductor end member being releasably attachable to the body member second end.

19. The liquid draining structure of claim 18 wherein the liquid conductor body member includes:

a body member first opening located at the body member first end and configured to allow the entry of liquid through the body member first opening from the first side of the barrier into the passageway at the entry end of the liquid conductor while precluding the entry through the body member first opening into the passageway of material that would materially compromise the free flow of liquid through the passageway; and a body member second opening located at the discharge end of the liquid conductor at the liquid conductor end member in liquid communication with the passageway, a discharge screening element located at the body member second opening and configured to allow the discharge of liquid through the body member second opening from the passageway while both precluding the entry into the passageway at the discharge end of the liquid conductor of material that would materially compromise the free flow of liquid through the passageway and limiting an access for pests to enter the passageway at the second opening.

20. The liquid draining structure of claim 16 wherein the entry screening element is releasably attachable at the liquid conductor body member at the entry end of the liquid conductor, and the discharge screening element is releasably attachable at the liquid conductor end member at the discharge end of the liquid conductor.

21. The liquid draining structure of claim 16 wherein the liquid conductor body member is configured to rest at least in part on the surface at the second side of the barrier, a portion of each of the liquid conductor body member and the passageway being configured to extend beyond an outer boundary of the surface at the second side of the barrier, and a closure element, the length of which can be adjusted, configured to close off the bottom portion of the passageway that extends beyond the outer boundary of the surface at the second side of the barrier.

22. The liquid draining structure of claim 20 wherein the barrier comprises a base rail to which a screen of a screened-in enclosure is attached.

23. The liquid draining structure of claim 13, wherein the liquid conductor comprises a plurality of modular sections releasably attachable to one another.

24. The liquid draining structure of claim 23 wherein the plurality of modular sections are of a configuration and are arranged with respect to one another so that the entry end of the liquid conductor is offset from the discharge end of the liquid conductor, whereby the passageway includes at least one bend.

* * * * *